US010457364B2

(12) United States Patent
Wung

(10) Patent No.: US 10,457,364 B2
(45) Date of Patent: Oct. 29, 2019

(54) MASK-TYPE GOGGLES USED FOR SWIMMING AND DIVING

(71) Applicant: Dongguan Longwell Sports Co., Ltd., Dongguan (CN)

(72) Inventor: Chin Hsien Wung, Dongguan (GD)

(73) Assignee: DONGGUAN LONGWELL SPORTS CO., LTD., Dongguan, Guangdong (CN)

( * ) Notice: Subject to any disclaimer, the term of this patent is extended or adjusted under 35 U.S.C. 154(b) by 393 days.

(21) Appl. No.: 15/362,821

(22) Filed: Nov. 29, 2016

(65) Prior Publication Data

US 2018/0148145 A1 May 31, 2018

(51) Int. Cl.
*A61F 9/02* (2006.01)
*B63C 11/12* (2006.01)

(52) U.S. Cl.
CPC ..... *B63C 11/12* (2013.01)

(58) Field of Classification Search
CPC ..... B63C 11/12; B63C 2011/121; B63C 2011/125; B63B 33/00
USPC ..... 2/442, 422
See application file for complete search history.

(56) References Cited

U.S. PATENT DOCUMENTS 5,479,917 A * 1/1996 Hsieh ..... B63C 11/12 128/200.29
5,899,918 A * 5/1999 Knott ..... A61B 17/12 606/204
2005/0015863 A1* 1/2005 Chiang ..... A63B 33/002 2/442
2014/0013494 A1* 1/2014 Godoy ..... A61F 9/02 2/428

* cited by examiner

*Primary Examiner* — Timothy K Trieu
(74) *Attorney, Agent, or Firm* — Leong C. Lei

(57) ABSTRACT

Mask-type goggles used for swimming and diving includes a soft rubber mask, a lens, a transparent frame, a decorative strip, and a lens fixing frame. A decorative strip is embedded in the inner side of a transparent frame so that the color of the decorative strip can be displayed through a frame, and the transmission of light of the frame makes the goggles as a whole colorful to improve the aesthetics of the goggles. Besides, the decorative strip is fixedly embedded in the frame, which can effectively prevent the decorative strip from falling off, such that the goggle structure is more stable and durable.

7 Claims, 5 Drawing Sheets

MASK-TYPE GOGGLES USED FOR SWIMMING AND DIVING

BACKGROUND OF THE INVENTION

1. Field of the Invention

The present invention relates to a swimming and diving gear, and more particularly to mask-type goggles used for swimming and diving.

2. Description of the Prior Art

Goggles used for water sports, swimming, snorkeling and diving can be classified into two types, an eyeglasses type (without a structure to cover the nose) and a mask type (a soft mask to cover at least the eyes and the nose). Because the former doesn't cover the nose, it is only used in a swimming pool, and the like. The latter can be used for swimming, snorkeling, diving and so on. In order to make the goggles more gorgeous, the goggles are provided with a colored decorative strip. In general, the decorative strip is fixed to the goggles by wedging or adhesive. The decorative strip may fall off after a long-term of use to affect the appearance of the goggles. Therefore, the existing goggles should be improved to solve the above problems. Accordingly, the inventor of the present invention has devoted himself based on his many years of practical experiences to solve this problem.

SUMMARY OF THE INVENTION

The primary objective of the present invention is to overcome the shortcomings of the prior art and to provide mask-type goggles used for swimming and diving. A decorative strip is embedded in an inner side of a transparent frame, which can effectively prevent the decorative strip from falling off, such that the goggle structure is more stable and durable.

In order to achieve the aforesaid objective, the mask-type goggles used for swimming and diving of the present invention comprises a soft rubber mask, a lens, a transparent frame, a decorative strip, and a lens fixing frame. The soft rubber mask has a fitting cavity at an inner side thereof for attaching to a user's face. A front of the soft rubber mask has a lens hole communicating with the fitting cavity. An inner edge of the lens hole is circumferentially formed with a lens groove for fitting the lens. The lens is mounted to the lens groove. The frame is configured to cover an outer edge of the lens hole. The frame comprises a rim. An inner side of the rim is formed with a decorative groove. The decorative strip is embedded in the decorative groove. The lens fixing frame is mounted in the frame to block an outer edge of the lens.

Preferably, the frame comprises two rims and a ridge portion between the two rims. Upper edges of inner sides of the two rims are formed with a first decorative groove. An inner edge of the ridge portion is formed with a second decorative groove. The decorative strip includes a first decorative strip and a second decorative strip. The first decorative strip is embedded in the first decorative groove. The second decorative strip is embedded in the second decorative groove.

Preferably, the first decorative groove and the first decorative strip are shaped like a chevron. The second decorative groove and the second decorative strip are shaped like a reverse V.

Preferably, an edge of the lens fixing frame is provided with a positioning block. An edge of the rim of the frame is formed with a positioning groove corresponding to the positioning block. The positioning block is embedded in the positioning groove.

Preferably, an edge of the lens fixing frame is provided with a positioning protrusion projecting outwardly. An edge of the rim of the frame is formed with a positioning notch corresponding to the positioning protrusion. The positioning protrusion is embedded in the positioning notch.

Preferably, the soft rubber mask has two lens holes. Each of the lens holes is formed with the lens groove. A sealing ring is provided in the lens groove for preventing water from entering the fitting cavity. The lens is mounted above the sealing ring.

Preferably, a limit block is provided on a top of the soft rubber mask. A top of the frame has a limit notch corresponding to the limit block. The limit block is engaged in the limit notch.

Preferably, the soft rubber mask has a pair of connection portions at two sides thereof for connecting a goggle strap.

Preferably, the soft rubber mask is made of a silicone rubber material.

Compared to the prior art, the present invention has the following advantages and beneficial effects. Specifically, the decorative strip is embedded in the inner side of the transparent frame so that the color of the decorative strip can be displayed through the frame, and the transmission of light of the frame makes the goggles as a whole colorful to improve the aesthetics of the goggles. Besides, the decorative strip is fixedly embedded in the frame, which can effectively prevent the decorative strip from falling off, such that the goggle structure is more stable and durable.

DETAILED DESCRIPTION OF THE PREFERRED EMBODIMENTS

Embodiments of the present invention will now be described, by way of example only, with reference to the accompanying drawings.

Figure 1:
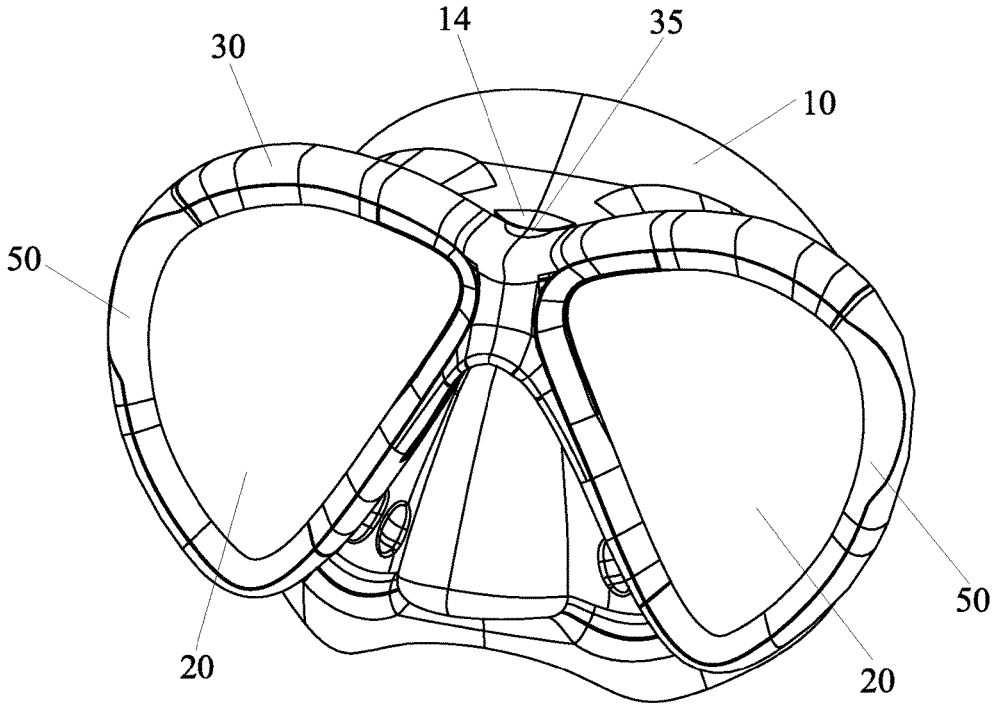
FIG. 1 is a perspective view according to a preferred embodiment of the present invention.
Figure 2:
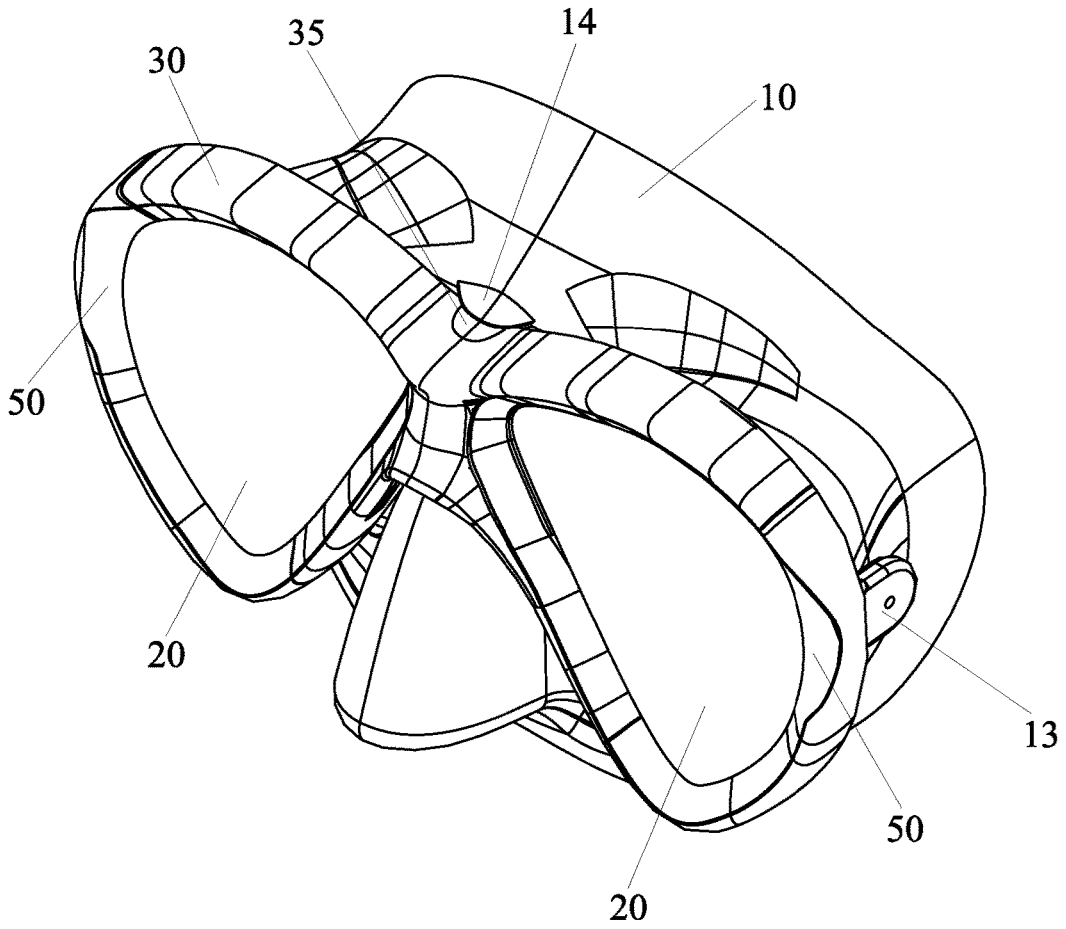
FIG. 2 is another perspective view according to the preferred embodiment of the present invention.
Figure 3:
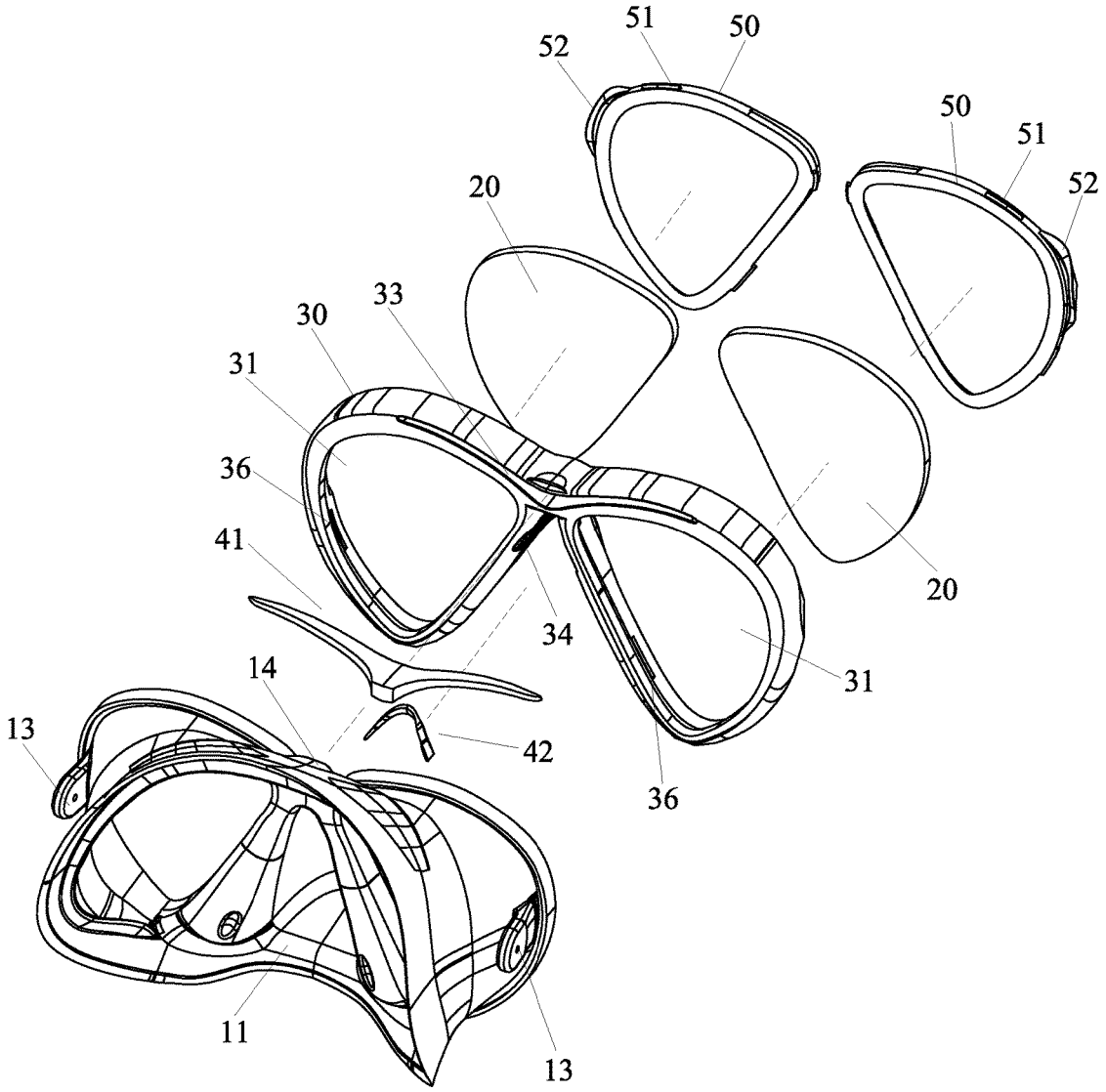
FIG. 3 is an exploded view according to the preferred embodiment of the present invention.
Figure 4:
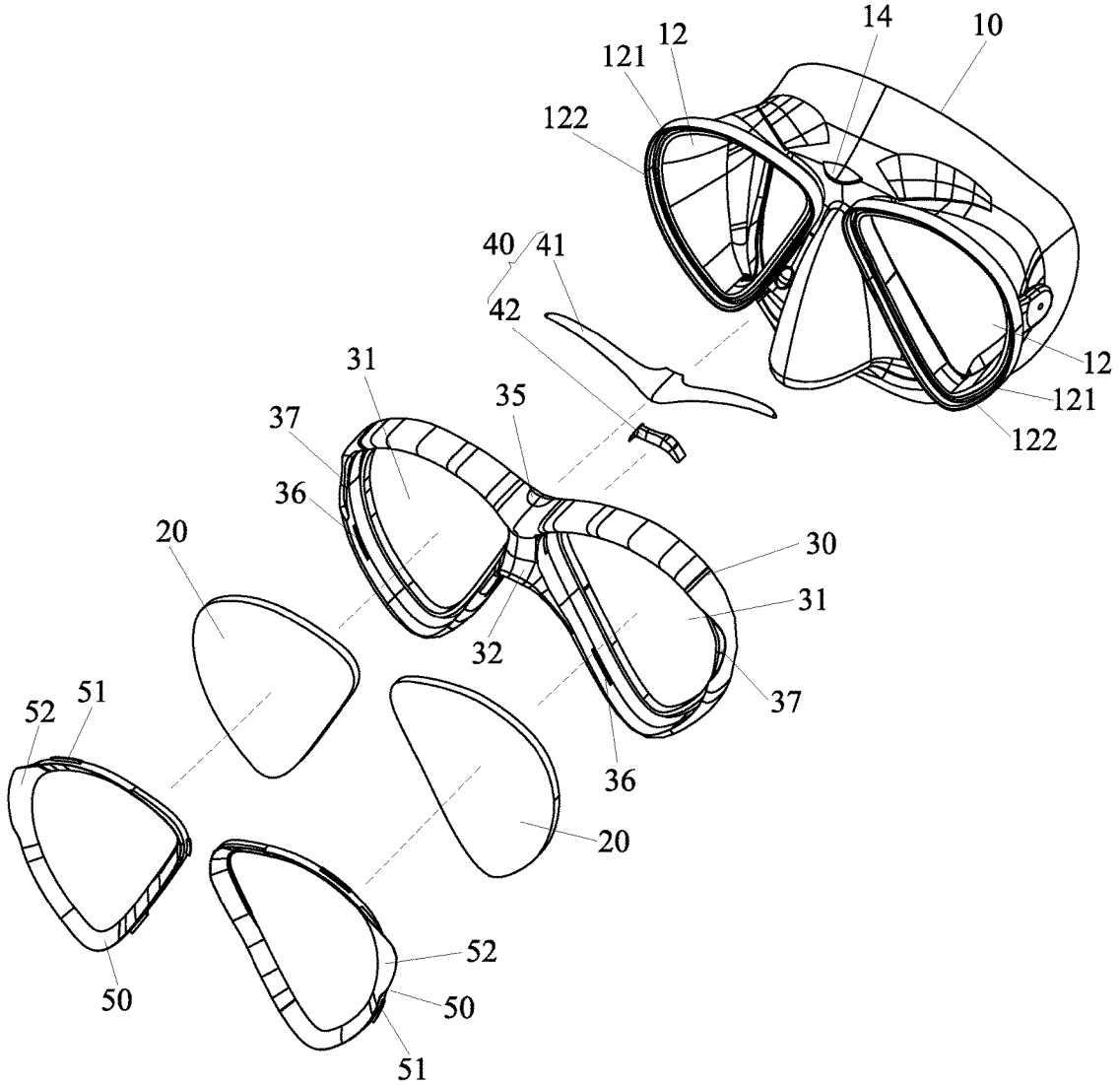
FIG. 4 is another exploded view according to the preferred embodiment of the present invention.
Figure 5:
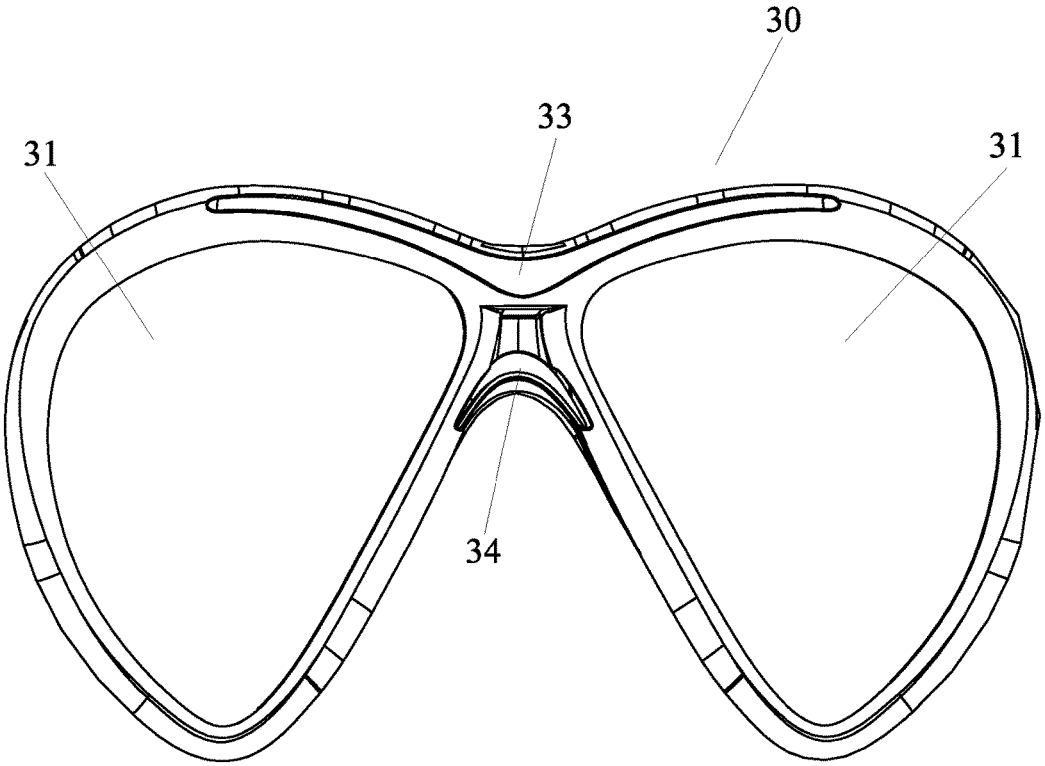
FIG. 5 is a top view of the frame according to the preferred embodiment of the present invention.

As shown in FIG. 1 to FIG. 5, the present invention discloses mask-type goggles used for swimming and diving. The mask-type goggles comprise a soft rubber mask 10, a lens 20, a transparent frame 30, a decorative strip 40, and a lens fixing frame 50.

The soft rubber mask 10 has a fitting cavity 11 at an inner side thereof for attaching to a user's face. The front of the soft rubber mask 10 has two lens holes 12 communicating with the fitting cavity 11. The inner edge of each lens hole 12 is circumferentially formed with a lens groove 121 for fitting the lens 20. A sealing ring 122 is provided in the lens groove 121 for preventing water from entering the fitting cavity 11. The soft rubber mask 10 is made of a silicone rubber material. The soft rubber mask 10 has a pair of connection portions 13 at two sides thereof for connecting a goggle strap. A limit block 14 is provided on the top of the soft rubber mask 10.

The lens 20 is mounted to the lens groove 121 and located above the sealing ring 122. The water entering from the gap between the lens 20 and the lens groove 121 is blocked by the sealing ring 122, preventing the water from entering the fitting cavity 11.

The frame 30 is configured to cover the outer edges of the lens holes 12. The frame 30 comprises two rims 31 and a ridge portion 32 between the two rims 31. The upper edges of the inner sides of the two rims 31 are formed with a first decorative groove 33. The inner edge of the ridge portion 32 is formed with a second decorative groove 34. The decorative strip 40 includes a first decorative strip 41 and a second decorative strip 42. The first decorative strip 41 is embedded in the first decorative groove 33. The second decorative strip 42 is embedded in the second decorative groove 34. The first decorative groove 33 and the first decorative strip 41 are shaped like a chevron. The second decorative groove 34 and the second decorative strip 42 are shaped like a reverse V. The top of the frame 30 has a limit notch 35 corresponding to the limit block 14 of the soft rubber mask 10. The limit block 14 is engaged in the limit notch 35. The engagement of the limit block 14 and the stop notch 35 acts as a support for the upper end of the soft rubber mask 10.

The lens fixing frame 50 is mounted in the frame 30 to block the outer edge of the lens 20. A positioning block 51 is provided at the edge of the lens fixing frame 50. The edge of each rim 31 of the frame 30 is formed with a positioning groove 36 corresponding to the positioning block 51. The positioning block 51 is embedded in the positioning groove 36. The edge of the lens fixing frame 50 is provided with a positioning protrusion 52 projecting outwardly. The edge of each rim 31 of the frame 30 is formed with a positioning notch 37 corresponding to the positioning protrusion 52. The positioning protrusion 52 is embedded in the positioning notch 37. The engagement of the positioning block 51 and the positioning groove 36 and the engagement of the positioning projection 52 and the positioning notch 37 enable the lens fixing frame 50 to attach to the frame 30 tightly, preventing the lens 20 from falling off.

The feature of the present invention is that the decorative strip is embedded in the inner side of the transparent frame so that the color of the decorative strip can be displayed through the frame, and that the transmission of light of the frame makes the goggles as a whole colorful to improve the aesthetics of the goggles. Besides, the decorative strip is fixedly embedded in the frame, which can effectively prevent the decorative strip from falling off, such that the goggle structure is more stable and durable.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. Mask-type goggles used for swimming and diving, comprising a soft rubber mask, a lens, a transparent frame, a decorative strip, and a lens fixing frame, the soft rubber mask having a fitting cavity at an inner side thereof for attaching to a user's face, a front of the soft rubber mask having a lens hole communicating with the fitting cavity, an inner edge at lens hole being circumferentially formed with a lens groove for fitting the lens, the lens being mounted to the lens groove, the transparent frame being configured to cover an outer edge of the lens hole, the transparent frame comprising a rim, an inner side of the rim being formed with a decorative groove, the decorative strip being embedded in the decorative groove, the lens fixing frame being mounted in the frame to block an outer edge of the lens, wherein the transparent frame comprises two rims and a ridge portion between the two rims, upper edges of inner sides of the two rims are formed with a first decorative groove, an inner edge of the ridge portion is formed with a second decorative groove, the decorative strip includes a first decorative strip and a second decorative strip, the first decorative strip is embedded in the first decorative groove, the second decorative strip is embedded in the second decorative groove, the first decorative groove and the first decorative strip are shaped like a chevron, and the second decorative groove and the second decorative strip are shaped like a reverse V.

2. The mask-type goggles used for swimming and diving as claimed in claim 1, wherein an edge of the lens fixing frame is provided with a positioning block, an edge of the rim of the frame is formed with a positioning groove corresponding to the positioning block, and the positioning block is embedded in the positioning groove.

3. The mask-type goggles used for swimming and diving as claimed in claim 1, wherein an edge of the lens fixing frame is provided with a positioning protrusion projecting outwardly, an edge of the rim of the frame is formed with a positioning notch corresponding to the positioning protrusion, and the positioning protrusion is embedded in the positioning notch.

4. The mask-type goggles used for swimming and diving as claimed in claim 1, wherein the soft rubber mask has two lens holes, each of the lens holes is formed with the lens groove, a sealing ring is provided in the lens groove for preventing water from entering the fitting cavity, and the lens is mounted above the sealing ring.

5. The mask-type goggles used for swimming and diving as claimed in claim 1, wherein a limit block is provided on a top of the soft rubber mask, a top of the frame has a limit notch corresponding to the limit block, and the limit block is engaged in the limit notch.

6. The mask-type goggles used for swimming and diving as claimed in claim 1, wherein the soft rubber mask has a pair of connection portions at two sides thereof for connecting a goggle strap.

7. The mask-type goggles used for swimming and diving as claimed in claim 1, wherein the soft rubber mask is made of a silicone rubber material.

* * * * *